United States Patent [19]

Decker

[11] 4,376,877

[45] Mar. 15, 1983

[54] MULTIPOSITION SWITCH

[76] Inventor: Melvin H. Decker, 7242 John Paul Dr. #102, Alexandria, Va. 22306

[21] Appl. No.: 282,323

[22] Filed: Jul. 10, 1981

[51] Int. Cl.[3] ..... H01H 1/20

[52] U.S. Cl. ..... 200/1 B; 200/17 B; 200/153 H; 200/201; 200/243; 338/155; 338/190

[58] Field of Search ..... 200/1 R, 1 B, 1 V, 11 TC, 200/5 R, 5 A, 6 A, 17 R, 17 A, 17 B, 18, 201, 277, 153 A, 153 B, 153 H, 271, 275, 243, 335, 153 V; 338/185, 190, 155, 157, 153

[56] References Cited

U.S. PATENT DOCUMENTS 2,134,323 10/1938 Beach ..... 200/1 B

*Primary Examiner*—A. T. Grimley
*Assistant Examiner*—Morris Ginsburg
*Attorney, Agent, or Firm*—Griffin, Branigan & Butler

[57] ABSTRACT

A multiposition switch, particularly suited for use as a motor speed controller, includes pairs of fixed contacts disposed in two parallel rows, and an arcuately shaped elongated movable contact. The movable contact rocks across successive pairs of the fixed contacts to make contact between a given pair of fixed contacts before contact is broken between a preceding pair. The movable contact is freely supported and rocked in response to forces exerted thereon by first and second rollers. The first roller is supported on a lever which is pivotable about a movable point so that as the lever is moved from an off position the first roller applies a force to the movable contact proximate a second end thereof. The second roller is supported on a pivotable member and applies a force to the movable contact proximate the first end thereof tending to return the contact to the off position. The pivotable member carries the movable pivot about which the lever pivots, and tension springs are connected between the pivotable member and the lever whereby the movable parts of the switch are biased towards the off position.

9 Claims, 5 Drawing Figures

MULTIPOSITION SWITCH

BACKGROUND OF THE INVENTION

The present invention relates to a multiposition switch or controller. More particularly, the invention relates to a multiposition switch or controller especially suited for use as a motor speed controller. The multiposition switch is particularly adapted for use as a motor speed controller in applications such as battery powered automobiles, forklifts, golf carts and other recreational vehicles.

Various forms of controllers have heretofore been utilized as motor speed controllers in battery powered automobiles, the most common types using magnetic contactors or SCR controlled solid state circuits. These controllers are typically quite heavy and expensive. On the other hand, it is desirable that such controllers be small to conserve space in the vehicle and light-weight in order that the battery may power the vehicle for a longer time without recharging.

SUMMARY OF THE INVENTION

An object of the present invention is to provide a multiposition switch or controller which is small, light-weight, relatively inexpensive to manufacture, and easy to service.

An object of the present invention is to provide a multiposition switch comprising a plurality of contacts, an arcuately shaped elongated movable contact, means for applying the force to the movable contact proximate one end thereof to urge the movable contact toward the fixed contacts, and actuator means for applying a force to said movable contact proximate a second end thereof to rock the movable contact across the plurality of contacts.

An object of the present invention is to provide a multiposition switch as described above wherein the actuator means comprises a movable pivot, a lever mounted for pivotable movement about the movable pivot, and means mounted on the lever for supporting a roller means in rolling engagement with the movable contact for applying the force proximate the second end of the movable contact.

An object of the present invention is to provide a multiposition switch as described above wherein the means for applying a force to the movable contact proximate one end thereof comprises a second roller means and pivotally supported means, the second roller means being mounted on the pivotally supported means and in rolling engagement with the movable contact.

Another object of the invention is to provide a multiposition switch comprising a plurality of fixed contacts disposed in first and second parallel rows with a plurality of contacts in each of the rows, an arcuately shaped elongated movable contact, the movable contact being wide enough to simultaneously contact a fixed contact in each of the rows, means for applying a force to the movable contact proximate one end thereof to urge the movable contact toward the fixed contacts, and actuator means for applying a variable force to the movable contact proximate a second end thereof to rock the movable contact across the fixed contacts.

Other objects of the invention and its mode of operation will become apparent upon consideration of the following description and the accompanying drawings.

DETAILED DESCRIPTION OF THE INVENTION

Figure 1:
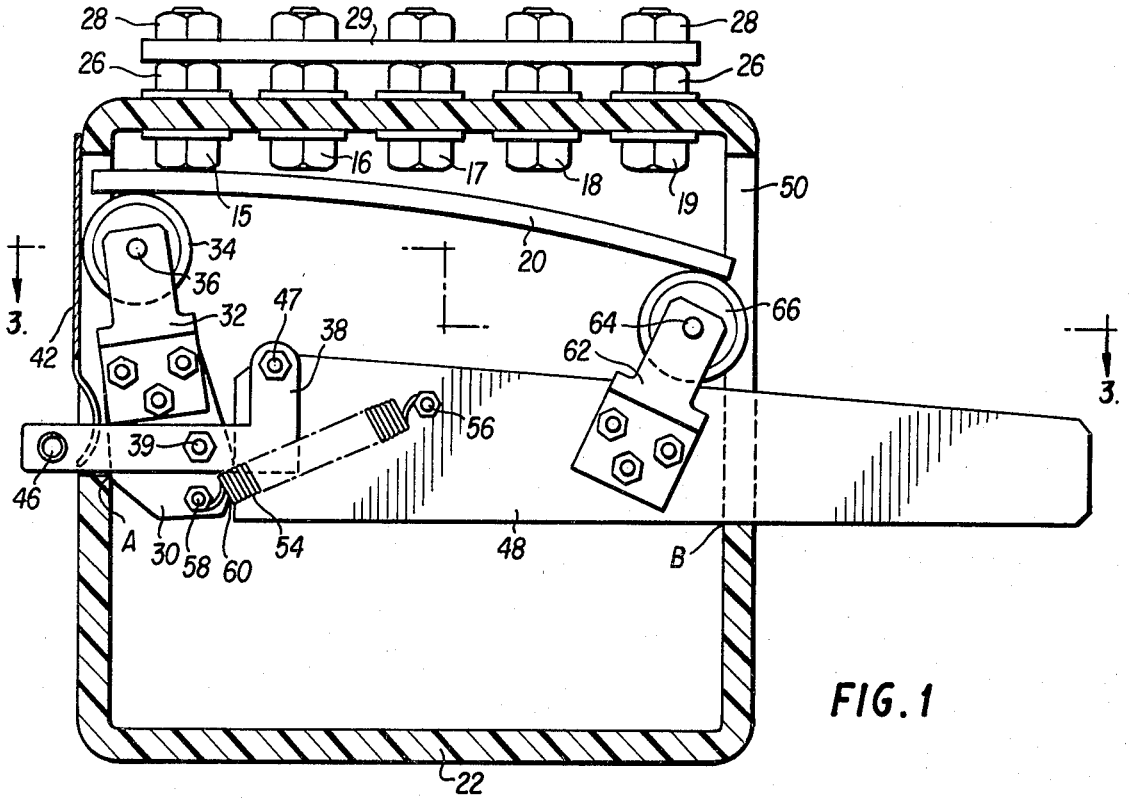
FIG. 1 is a front elevation view of a multiposition switch in the off position.

As illustrated in FIGS. 1–5, a preferred embodiment of a multiposition switch constructed in accordance with the principles of the present invention comprises a first row of fixed electrically conductive contacts 10–14 (FIG. 4), a second row of fixed contacts 15–19, and an arcuately shaped elongated electrically conductive movable contact 20, all disposed within a housing 22. The housing 22 may be made of plastic or metal and, if metal, lined with an insulating lining (not shown). The housing may be substantially closed to reduce the possibility of dirt and other foreign matter collecting on the contacts.

The fixed contacts 10–19 extend through housing 22 to the outside of the housing, the contacts extending through insulating bushings if the housing is made of metal. The fixed contacts are conductive bolts having threads thereon. Conductive nuts 26 are threaded on the bolts and tightened to hold the fixed contacts in place. Additional nuts 28 are provided for connecting leads from external circuits to the fixed contacts. Nuts 28 may also secure a shorting bar 29 to the fixed contacts 15–19 to electrically connect these contacts in common in some applications.

Figure 4:
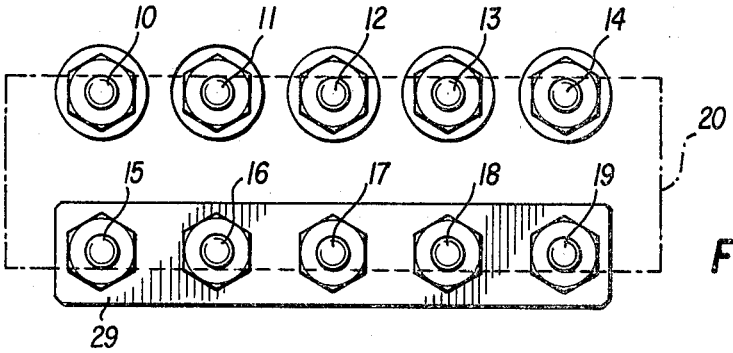
FIG. 4 is a top view (without housing or actuating mechanism) showing the arrangement of the switch contacts; and, FIG. 5 is a partial left side elevation of the multiposition switch shown in FIG. 1.
Figure 5:
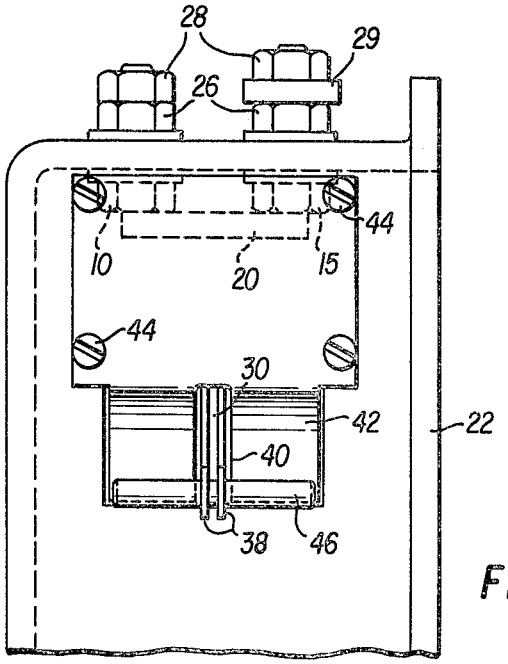

As best illustrated in FIG. 4, the fixed contacts 10–14 and 15–19 are arranged in sets or pairs, the sets comprising contacts 10 and 15, 11 and 16, 12 and 17, 13 and 18, and 14 and 19. The movable contact 20 is wide enough to bridge the two contacts of a set so that as the movable contact 20 is rocked across the fixed contacts it successively shorts the two contacts of each set. Since the fixed contacts act as a fulcrum against which movable contact 20 is rocked, each succeeding set of fixed contacts is bridged before the circuit between the preceding set of fixed contacts is broken. Because of the arcuate shape of movable contact 20, the fixed contacts of no more than two sets are bridged at any one time.

Means are provided for applying a force to movable contact 20 proximate the left end thereof (FIG. 1) to urge the movable contact toward the fixed contacts. This means comprises a plate 30 having two brackets 32 mounted thereon. A roller means such as a Teflon roller 34 is supported by a bearing pivot 36 extending through brackets 32.

Two L-shaped members 38 are rigidly connected to plate 30 by a suitable fastening means 39. One leg of each member 38 extends through a slot 40 (FIG. 5) which is cut in a cover plate 42, the cover plate being attached to housing 22 by screws 44. A pin 46 extends horizontally through members 38 externally of the switch housing and cooperates with cover plate 42 to limit the travel of the switch as subsequently described.

The other leg of each L-shaped member 38 supports a movable pivot 47. A lever 48 extends through an opening 50 on the right side of the housing and lever 48 is pivoted on the movable pivot 47 between the members 38. A slotted cover (not shown) may be secured to the right side of housing 22 to limit the access of foreign material to the inside of the housing while permitting movement of the lever 48 between the positions illustrated in FIGS. 1 and 2.

Tension springs 54 are attached to posts 56 and 58 mounted on lever 48 and plate 30, respectively. The posts 56 and 58 are located with respect to movable pivot 47 such that the tension springs 54 tend to urge lever 48 clockwise and members 38 and plate 30 counterclockwise about the movable pivot 47. The plate 30 is rounded in the region 60 so that the plate 30 does not interfere with the movement of lever 48 as the plate 30 and lever 48 are moved by the tension springs 54.

As best shown in FIG. 1, the counterclockwise movement of plate 30 under the tension of springs 54 is limited by the legs of L-shaped members 38 which come into contact with the housing 22 at a pivot or fulcrum point A. The clockwise movement of lever 48 in response to the force exerted by tension springs 54 is limited by the housing 22 which the lever 48 contacts at point B. Because plate 30 and lever 48 are pivotally connected at movable pivot 47, the tension in springs 54 tends to move pivot 47 upwardly when plate 30 is fulcrumed at point A and lever 48 is stopped by housing 22 at point B. This upward movement is limited by roller 34 which presses against movable contact 20 thereby urging the left end of the movable contact (as viewed in FIG. 1) toward the fixed contacts. When the switch is in the off position, roller 34 also presses against cover plate 42.

The lever 48 comprises part of a means for applying a variable force to the movable contact 20 proximate the right end (FIG. 1) of the contact to thereby rock the movable contact across the fixed contacts. The means for applying a variable force further includes two brackets 62 mounted on lever 48 and having a bearing support 64 for supporting a roller 66 against the movable contact 20. Preferably, roller 66 is made of Teflon or another suitable non-conductive material.

When the switch is in the off position as shown in FIG. 1, roller 34 presses upwardly on the movable contact in the region of the contact extending to the left (as viewed in FIG. 1) of fixed contacts 10 and 15. The contacts 10 and 15 act as a fulcrum such that the right end of movable contact 20 is forced downwardly against roller 66.

As the switch is moved from the home or off position, several things occur. An upward force applied to operating lever 48 externally of the housing pivots lever 48 about the movable pivot 47 thereby causing roller 66 to apply an upward force to the bottom of movable contact 20 near its right end. The roller 66 acts as a fulcrum and as the right end of lever 48 is moved upwardly the left end of the lever bears downwardly on movable pivot 47. The pivot 47, in turn, exerts a downwardly and rightwardly directed force on the L-shaped members 38. The members 38 pivot in a clockwise direction about point A thereby causing plate 30 and roller 34 to move clockwise about the same point.

As lever 48 is moved further upwardly, roller 66 moves upwardly thereby forcing the right end of movable contacts 20 closer and closer to the fixed contacts. At the same time, roller 34 swings to the right and downwardly in an arc thereby permitting the left end of movable contact 20 to move away from the fixed contacts.

Initially, movable contact 20 bridges fixed contacts 10 and 15 which serve as a fulcrum for rocking the movable contact. As lever 48 is moved upwardly, the movable contact bridges fixed contacts 11 and 16 while still bridging fixed contacts 10 and 15. At this point contacts 11 and 16 become the fulcrum point for rocking the movable contact 20 so that upon further upward movement of lever 48 the movable contact 20 breaks contact with fixed contacts 10 and 15 so that only contacts 11 and 16 are bridged.

From the above description it will be obvious that further upward movement of lever 48 causes a make-before-break sequence of operations in which fixed contacts 12 and 17 are bridged, the circuit between contacts 11 and 16 is broken, contacts 13 and 18 are bridged, the circuit between contacts 12 and 17 broken, contacts 14 and 19 are bridged, and finally, the circuit between contacts 13 and 18 is broken. At this point the operating elements of the switch are positioned as illustrated in FIG. 2.

Figure 2:
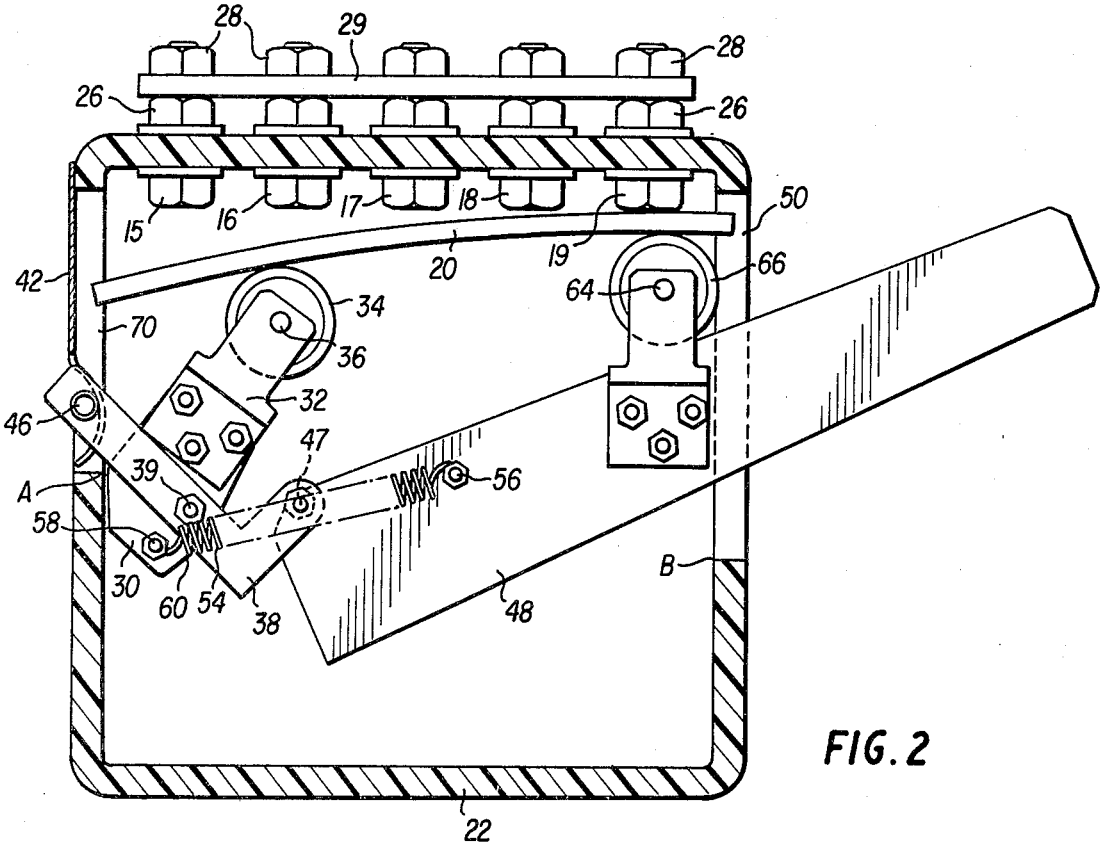
FIG. 2 is a front elevation view of the switch in a fully actuated position.
Figure 3:
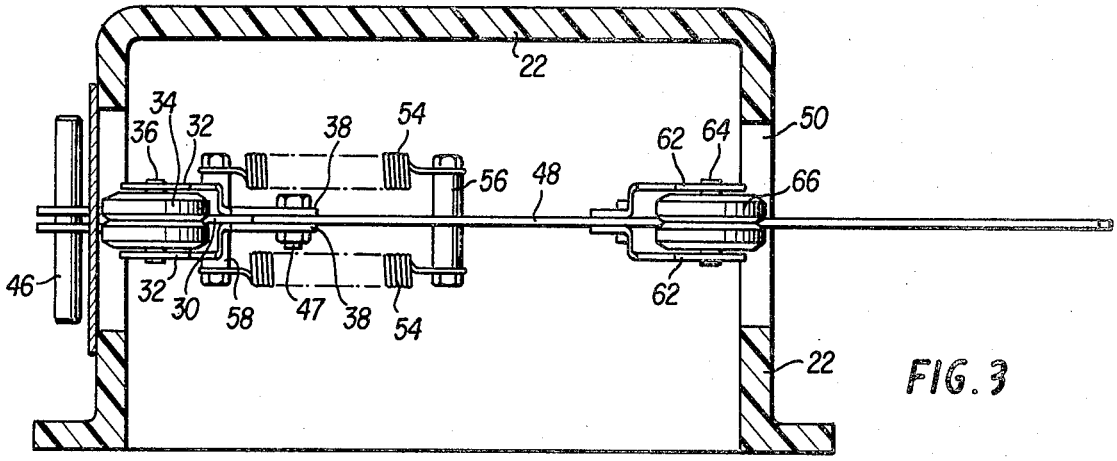
FIG. 3 is a top sectional view taken along the line 3—3 of FIG. 1.

It is possible to raise the lever 48 upwardly beyond the position shown in FIG. 2. If so moved, there could be sufficient translational movement of the legs of members 38 (resting on fulcrum point A) completely into the interior of the housing. The pin 46 engages cover plate 42 as shown in FIG. 2 which acts as a stop to prevent this from happening.

When the switch is in the position shown in FIG. 2, the tension in springs 54 urge the switch mechanism back to the off position illustrated in FIG. 1 as the upward force on lever 48 is reduced. Thus, the switch acts as a "dead man" switch that always returns to its off position when an operator releases or terminates the upward force on lever 48.

The movable contact 20 as well as all of the movable operating elements of the switch are easily removable in case replacement of these elements is required. The screws 44 (FIG. 5) are removed as is the cover plate 42. Plate 30 and members 38 may then be pivoted about pivot 47 and the entire operating mechanism including lever 48 withdrawn from the interior of the housing through the opening 70 (FIG. 2) in the left side of the housing.

From the foregoing description it is seen that the present invention provides a multiposition switch which is simple in construction, small, lightweight, and relatively inexpensive to produce. It provides a progressive make-before-break capability and acts as a deadman switch, always returning to the off position in the absence of a positive operating force.

While a preferred embodiment of the invention has been described in specific detail, it will be obvious to those skilled in the art that various substitutions and modifications may be made in the described embodiment without departing from the spirit and scope of the invention as defined by the appended claims.

The embodiments of the invention in which an exclusive property or privilege are claimed are defined as follows:

1. A multiposition switch comprising:

a plurality of fixed contacts;

an arcuately shaped elongated movable contact;

means for applying a force to said movable contact proximate a first end thereof to urge said movable contact toward said fixed contacts; and, actuator means for applying a force to said movable contact proximate a second end thereof to rock said movable contact across said plurality of contacts;

said movable contact being freely supported between said plurality of contacts on one side and said actuator means and said means for applying a force on the other side whereby said movable contact requires no permanent connection to either of the means for applying a force thereto.

2. A multiposition switch as claimed in claim 1 wherein said actuator means comprises:

a movable pivot;

a lever mounted for pivotal movement about said movable pivot;

means mounted on said lever for supporting a first roller means in rolling engagement with said movable contact for applying said force proximate said second end of said movable contact.

3. A multiposition switch as claimed in claim 1 wherein said means for applying a force to said movable contact proximate said first end thereof comprises:

roller means; and, pivotally supported means;

said roller means being mounted on said pivotally supported means and in rolling engagement with said movable contact.

4. A multiposition switch as claimed in claim 1 wherein said plurality of contacts are fixed contacts disposed in first and second parallel rows with a plurality of contacts in each of said rows, said movable contact being wide enough to simultaneously contact a fixed contact in each of said rows.

5. A multiposition switch as claimed in claim 4 wherein a set of contacts comprises a fixed contact in one of said rows and a corresponding fixed contact in the other of said rows, said movable contact being disposed to rock successively across each set of contacts by making contact with the fixed contacts of one set before breaking contact with the fixed contacts of a preceding set.

6. A multiposition switch as claimed in claim 2 wherein said means for applying a force to said movable contact proximate said first end thereof comprises:

second roller means; and, pivotally supported means;

said second roller means being mounted on said pivotally supported means and in rolling engagement with said movable contact.

7. A multiposition switch as claimed in claim 6 wherein said pivotally supported means includes means for supporting said movable pivot; and tension spring means connecting said lever to said pivotally supported means.

8. A multiposition switch as claimed in claim 7 wherein said tension spring means is connected to said lever at a point intermediate said movable pivot and said means mounted on said lever for supporting said first roller means, said tension spring means being connected to said pivotally supported means on the opposite side of said movable pivot from said movable contact, whereby said tension spring means tends to pivot said lever in a direction lessening the force applied to said movable contact by said roller means.

9. A multiposition switch as claimed in claim 8 and further including a housing having first and second openings on opposite sides thereof;

said fixed contacts being supported in said housing and extending through a top of said housing for receiving electrical connections;

said lever extending through said first opening with said housing serving as a stop to limit movement of said lever in response to said tension spring means; and, said pivotally supported means extending through said second opening with an edge of said housing at said opening serving as the pivot for said pivotally suported means.

* * * * *